US009938077B2

(12) United States Patent
Hallman

(10) Patent No.: US 9,938,077 B2
(45) Date of Patent: Apr. 10, 2018

(54) IN-GROUND RECEPTACLE AND INSTALLATION THEREOF

(71) Applicant: EARTHBIN INC., Hamilton (CA)

(72) Inventor: David Hallman, Innerkip (CA)

(73) Assignee: EARTHBIN INC., Hamilton, Ontario (CA)

( * ) Notice: Subject to any disclaimer, the term of this patent is extended or adjusted under 35 U.S.C. 154(b) by 0 days.

(21) Appl. No.: 15/145,291

(22) Filed: May 3, 2016

(65) Prior Publication Data

US 2017/0320664 A1 Nov. 9, 2017

(51) Int. Cl.
*B65F 1/14* (2006.01)

(52) U.S. Cl.
CPC ..... *B65F 1/1447* (2013.01)

(58) Field of Classification Search
CPC ..... B65F 1/1447
USPC ..... 405/129.1, 129.55, 129.57, 129.6; 220/567.1
See application file for complete search history.

(56) References Cited

U.S. PATENT DOCUMENTS 502,595 A 8/1893 St. George
607,524 A 7/1898 Reed
950,097 A 2/1910 Edgerton
2,528,056 A 10/1950 Henry
3,009,603 A * 11/1961 Stockdale ..... A01G 9/021 206/519
3,050,209 A 8/1962 Germaine et al.
3,307,739 A * 3/1967 Cloyd ..... B65D 21/022 206/508
3,634,989 A * 1/1972 Rogers ..... E04H 12/10 403/306

(Continued)

FOREIGN PATENT DOCUMENTS

CA 2744818 A1 1/2012
DE 2431090 A1 1/1976

(Continued)

OTHER PUBLICATIONS

Durabac, CSE-6500-P, Double layered polyethylene buried container, retrieved online on Oct. 15, 2010.

(Continued)

*Primary Examiner* — Tara Mayo-Pinnock
(74) *Attorney, Agent, or Firm* — Kenneth L. Bousfield; Bereskin & Parr LLP/S.E.N.C.R.L., s.r.l.

(57) ABSTRACT

An in-ground apparatus includes a receptacle and a liner into which the receptacle can be placed and removed. The liner may be a molded plastic liner having a tapering body to permit stacking. The lower margin includes a set of seats for anchor fittings in the form of re-bar prongs that, when installed, extend radially outwardly from the liner. The seats, and hence the prongs, are located upwardly of the bottom edge of the liner so that they are embedded above and below when concrete is poured around the bottom of the liner. The bottom edge of the liner is folded upwardly and inwardly to form a V-shaped channel. The seats for the anchor fittings extend across the channel. The seats may include a cylindrical wall sealed from the inside of the liner. The liner may have intermediate stiffening ribs between bottom and top. The top of the liner may have a seat for the receptacle, and an external concrete break.

24 Claims, 7 Drawing Sheets

(56) References Cited

U.S. PATENT DOCUMENTS

| | | | | |
|---|---|---|---|---|
| 3,708,085 | A * | 1/1973 | Bumpas | B65F 1/1623 220/262 |
| 3,893,538 | A * | 7/1975 | Thompson | B60V 3/025 104/23.2 |
| 4,082,184 | A * | 4/1978 | Hammer | B65D 21/0233 206/519 |
| 4,570,812 | A | 2/1986 | Curtis | |
| 4,659,251 | A * | 4/1987 | Petter | B65D 90/105 137/312 |
| 4,775,066 | A | 10/1988 | Keppeler | |
| 4,960,346 | A * | 10/1990 | Tamayo | B65D 90/105 137/371 |
| 5,238,356 | A | 8/1993 | Salli | |
| 5,339,974 | A * | 8/1994 | Raghunathan | C05F 17/0205 220/4.26 |
| 5,879,106 | A * | 3/1999 | Beamer | E01C 11/227 249/11 |
| 6,112,935 | A * | 9/2000 | Shackelford | E03F 3/02 220/484 |
| 6,443,656 | B1 * | 9/2002 | Gunter | E01C 19/506 403/308 |
| 7,690,150 | B2 * | 4/2010 | Orschulik | A01G 9/04 47/66.1 |
| 7,774,988 | B2 * | 8/2010 | Guitoneau | E02D 29/124 220/4.13 |
| 8,096,439 | B2 * | 1/2012 | Fogerlie | H02G 9/10 220/3.3 |
| 8,534,482 | B2 | 9/2013 | Tuunanen et al. | |
| 9,056,717 | B2 | 6/2015 | Lobban | |
| 9,066,511 | B2 * | 6/2015 | McKnight | A01M 1/026 |
| 9,451,761 | B2 * | 9/2016 | Messina | A01M 1/2011 |
| 2008/0203097 | A1 | 8/2008 | Cardoso Cabral Martins da Silva et al. | |
| 2009/0120013 | A1 * | 5/2009 | Meyers | E02D 29/12 52/20 |
| 2009/0242565 | A1 | 10/2009 | McLachlan | |
| 2010/0108688 | A1 * | 5/2010 | Stein | B65D 90/105 220/567.1 |
| 2013/0111801 | A1 * | 5/2013 | White | A01K 5/0142 43/109 |

FOREIGN PATENT DOCUMENTS

| | | | | |
|---|---|---|---|---|
| EP | 1061011 | A1 | 12/2000 | |
| EP | 2517981 | A1 | 10/2012 | |
| FR | EP 1061011 | A1 * | 12/2000 | B65F 1/1447 |
| SE | 509286 | C2 | 1/1999 | |
| WO | 2006032073 | A1 | 3/2006 | |

OTHER PUBLICATIONS

Durabac, CSE-8000, 8 yard capacity polyetylene Front Load Bin buried in the concrete casement, as published on www.durabac.ca, in Aug. 2012.

Ecoloxia, sales brochure as published at www.ecoloxia.ca/produits.html; copyright dated 2011.

Ecoloxia, sales brochure as published at www.groung-hog.ca/index.html; dated at least as early as Jul. 13, 2011.

Instructions installation manual: L&T Cube, dated at least as early as Dec. 2012.

Installation Manual: M-5000, M-3000 & M-1300; Installation Manual, Appendix 1 to RFQ#07-2013, published in Jan. 2012, by Molok North America Ltd.

BFI Canada: Installing a Front-Load In-Ground Container, dated at least as early as Aug. 29, 2012.

L&T advertisement for DeepLine Underground Waste Containers, Jun. 6, 2010.

Square Deep Load Underground Containers, as advertised by Ecoloxia in Nov. 2011.

FinBin Cube, Economical waste collection has never looked so good; retrieved from www.finbin.fi; dated at least as early as 2012.

* cited by examiner

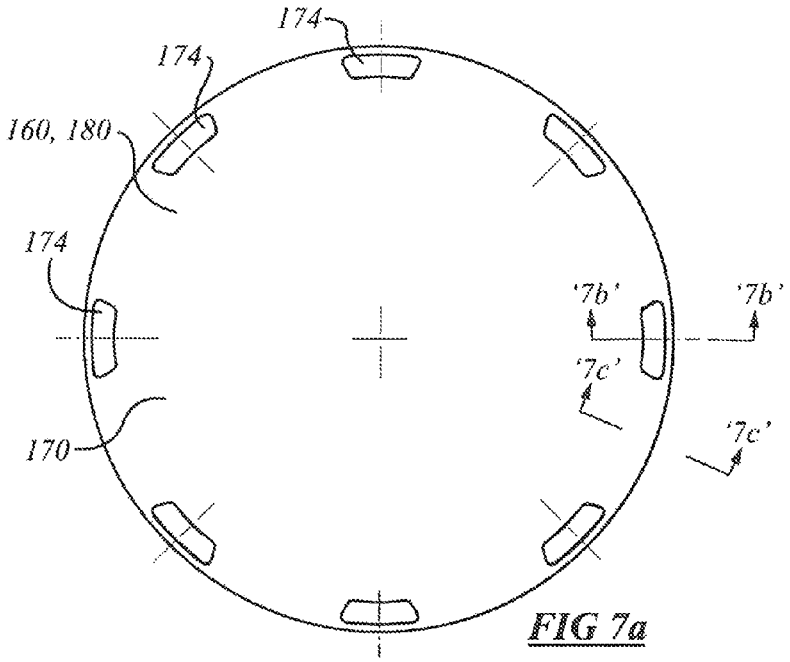
FIG 7a
FIG 7b
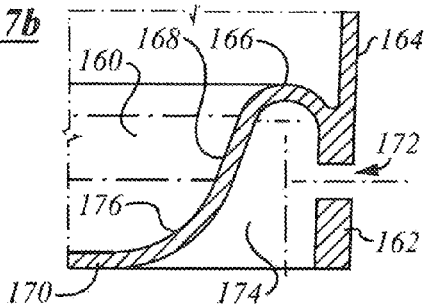
FIG 7c
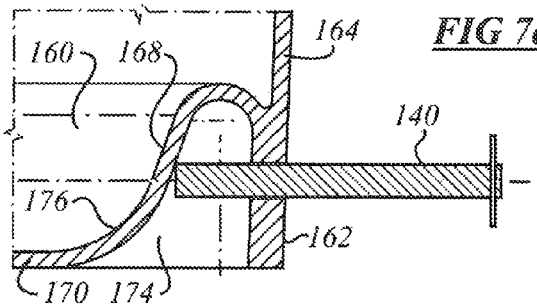
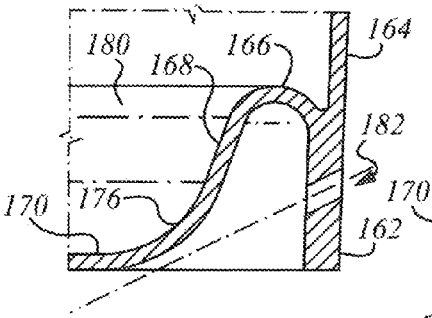
FIG 7d
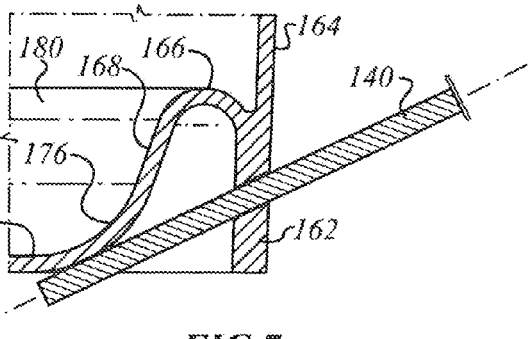
FIG 7e

IN-GROUND RECEPTACLE AND INSTALLATION THEREOF

FIELD OF THE INVENTION

This invention relates to the field of in-ground installations.

BACKGROUND OF THE INVENTION

Waste removal has long presented logistical challenges. In some locations, particularly those at fast-food restaurants, or in urban areas, a large waste receptacle is employed. Typically, the waste receptacle is filled by persons depositing waste over a period of time, and is emptied once or twice a week by a truck. The truck typically has a lifting device, such as lifting forks, and may have a compacting ram. Large receptacles, such as dumpsters, are frequently used for this purpose.

Whereas dumpsters tend to sit on the ground, it is also known to provide refuse collection apparatus that is partially buried, or sits in a well in which a significant portion of the apparatus is located below grade. An apparatus that sits partially below grade may tend to be less accessible to animals, may tend to be less easily overturned, may tend to be more resistant to freezing in winter, and may tend to stay cooler during days of warm sunshine. When the refuse remains at a cooler temperature, it may tend not to be as strong a source of odours. Low lift height provides for safer and more ergonomic loading of the bin—that is, the deposit by users occurs at a low and convenient height. In addition, no fencing is required in municipalities, which may tend significantly to reduce waste system requirements.

SUMMARY OF THE INVENTION

In an aspect of the invention there is a ground well liner. It has a bottom member and a peripheral wall extending thereabout and standing upwardly therefrom. The bottom member and the peripheral wall defining a chamber therewithin. The peripheral wall has an upper region and a lower region. The lower region of the peripheral wall has an array anchor seats defined therein. The anchor seats define moment connections.

In another aspect of the invention there is a ground well liner. It has a bottom member and a peripheral wall extending thereabout and standing upwardly therefrom. The bottom member and the peripheral wall define a chamber therewithin. The peripheral wall has an upper region and a lower region. The lower region has a lowermost margin that defines a beam. The beam includes at least a first web extending at least partially in the vertical direction and a second web extending at least partially in the vertical direction. There is a shear flow connection between the first and second webs. The first web is peripherally outwardly of the second web. The peripheral wall lower region has an array anchor seats defined in the beam.

In a feature of those aspects of the invention, the liner is nestingly stackable with other liners of the same type. In another feature, the liner is made of a polymeric material. In still another feature, the liner is water-tight. In another feature, the liner increases in girth upwardly, from a narrow bottom to a wider top. In a further feature, the liner includes at least one conically tapered wall section. In still another feature, the peripheral wall of the liner has at least one intermediate region spaced upwardly from the bottom member. The intermediate region has circumferentially extending stiffening spaced upwardly of the bottom member. In an additional feature, the circumferentially extending stiffening includes an anti-buckling local increase in second moment of area in the circumferential direction.

In still other features, the lower portion has a lowermost margin and the seats of the array of seats are spaced upwardly of the lowermost margin. In a further feature, the beam has a channel cross-section. In stall another feature the beam has a third web extending at least partially in the vertical direction, the third web being in shear flow connection with at least one of the first web and the second web. In another feature, the beam has a Z-section. In still another feature, a seat of the array of seats connects with both the first web of the beam and the second web of the beam. In still another feature, any seat of the array of seats is inclined upwardly and outwardly. In still another feature, any seat of the array of seats includes a cylindrical socket that is open to the outside. In another feature, the socket is a blind socket. In still another feature, the socket is sized to receive a length of re-bar. In yet another feature, the seats are excluded from communication with the chamber. In a further feature, the peripheral wall has a lowermost edge, and the seats are located upwardly of the lowermost edge.

In a still further feature, the upper portion has an upper rim defining an opening of the well, and the opening defines a land for mating engagement with a vessel sized to fit in the well. In an additional feature, the liner is employed in combination with a set of anchor fittings mounted in the anchor seats. In another feature, the anchor fittings are spaced circumferentially about the liner, and the anchor fittings protrude radially from the seats. In still yet another further feature, the anchor fittings are radially extending prongs. In still yet another feature, the prongs are made of straight lengths of re-bar.

In another aspect, there is a well liner having a bottom member and a peripheral wall extending thereabout and standing upwardly therefrom. The bottom member and the peripheral wall define a chamber therewithin. The peripheral wall has an upper region and a lower region. The lower region of the peripheral wall has an array of anchor seats defined therein. The lower region of the peripheral wall has a doubled lowermost margin. The anchor seats are located in the liner at a height that is upwardly of a bottommost extremity of the lowermost margin.

In a feature of that aspect, outwardly extending prongs are mounted in the seats and extend predominantly radially outwardly from the liner. In another feature, concrete is poured about the liner and the concrete extends both above and below the seats whereby the prongs are embedded in concrete above and below. In still another feature, the doubled lowermost edge of the peripheral wall includes a lowermost outermost outer wall, a radially inwardly and upwardly folded bottom rim. The lowermost outer wall and the upwardly folded bottom rim combine to define the doubled lowermost margin. The seats extend from the outermost wall to the inwardly upwardly folded bottom rim. In another feature, the lowermost edge of the peripheral wall defines at least a portion of a channel having an outer wall and an inner wall spaced therefrom, and the seats span the channel.

In a feature of that aspect, outwardly extending prongs are mounted in the seats. In another feature, concrete is poured about the liner and the concrete extends both above and below the seats whereby the prongs are embedded in concrete above and below. In still another feature the prongs extend radially outwardly from the liner. In still another feature, the lower region of the peripheral wall includes a lowermost outermost wall, a radially inwardly and upwardly folded bottom rim, and the seats extend from the outermost wall to the inwardly upwardly folded bottom rim. In yet another feature, the lower region of the peripheral wall defines a channel having an outer wall and an inner wall, and the seats span the channel.

In another aspect of the invention, there is any apparatus substantially as shown or described herein, in whole or in part.

BRIEF DESCRIPTION OF THE DRAWINGS

These aspects and other features of the invention can be understood with the aid of the following illustrations of a number of exemplary, and non-limiting, embodiments of the principles of the invention in which:

FIG. 7*a* shows a plan view of a bottom portion of an alternate embodiment of liner assembly to that of FIG. 2*a;*

FIG. 7*b* shows a cross-section of the liner of FIG. 7*a* taken on section '7*b*-7*b*' of FIG. 7*a*, being analogous to the cross-section of FIG. 5*a;*

FIG. 7*c* shows the cross-section of FIG. 7*b* with an anchor rod seated therein;

FIG. 7*d* show an alternate embodiment to that of FIG. 7*b*; and

FIG. 7*e* shows the embodiment of FIG. 7*d* with an anchor rod.

DETAILED DESCRIPTION

Figure 1A:
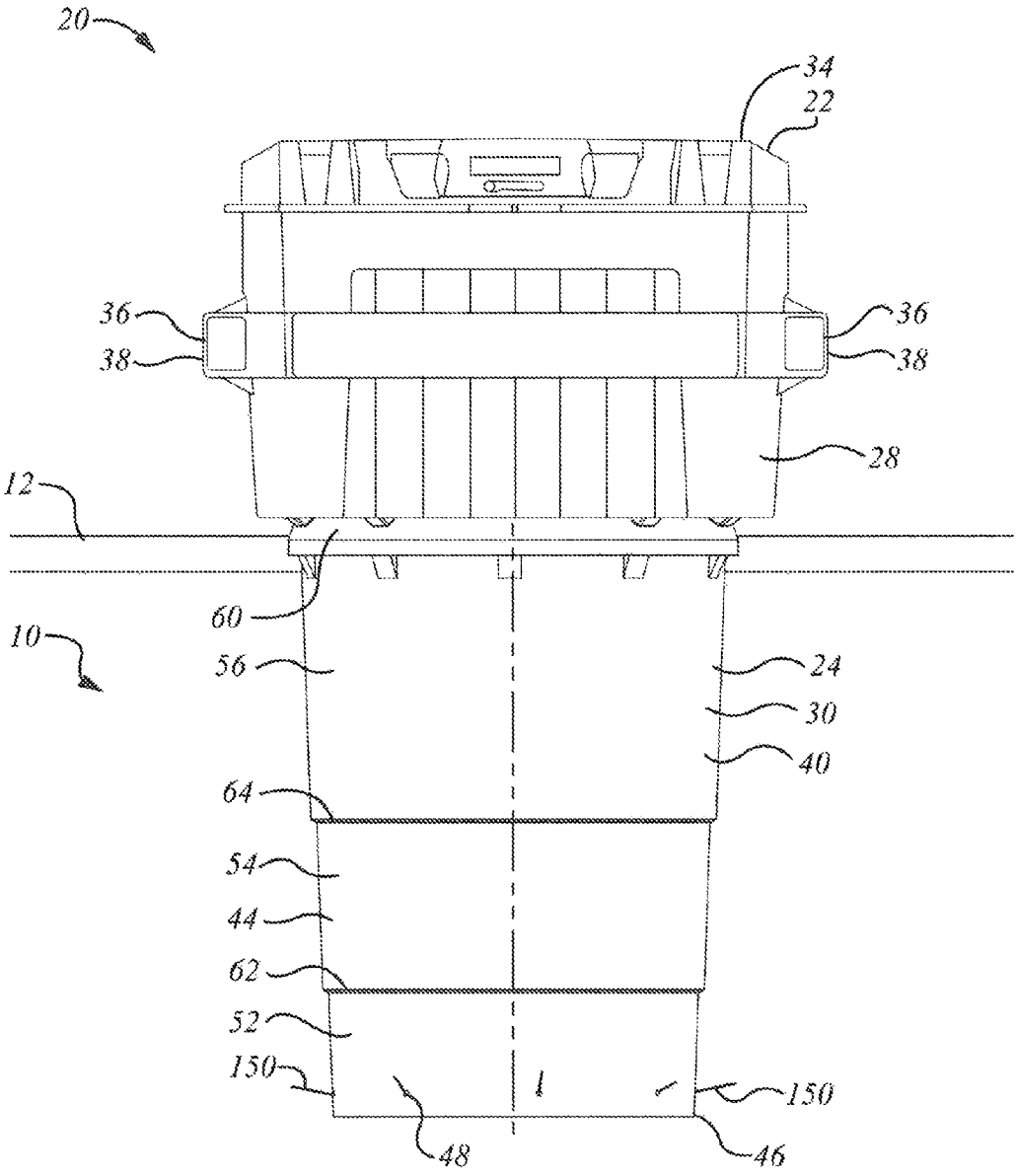
FIG. 1*a* shows a perspective general assembly view at an apparatus installation according to the present invention as installed with a soil or gravel cover.
Figure 1B:
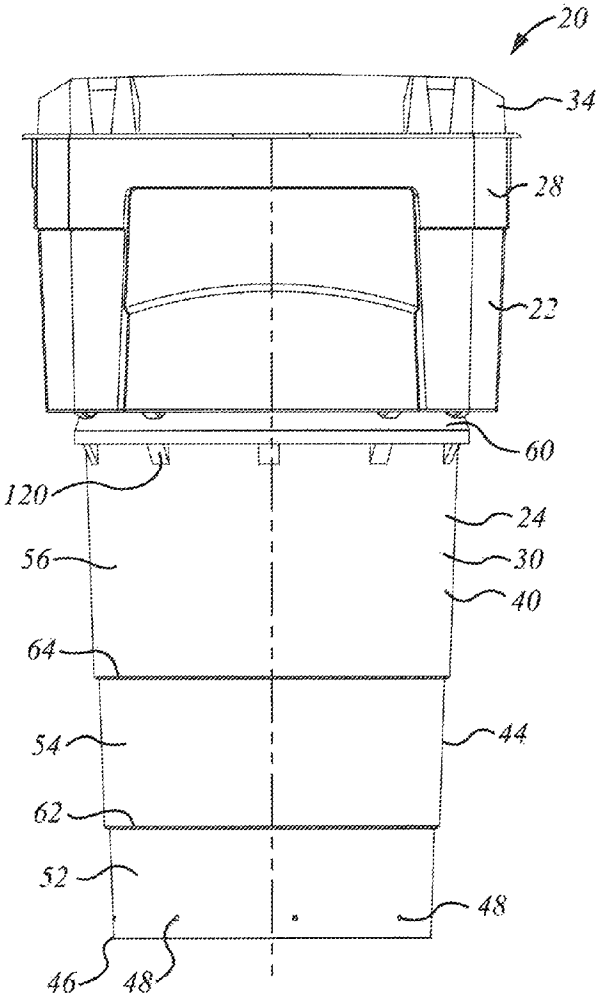
FIG. 1*b* shows the apparatus of FIG. 1*a* in side view.
Figure 1C:
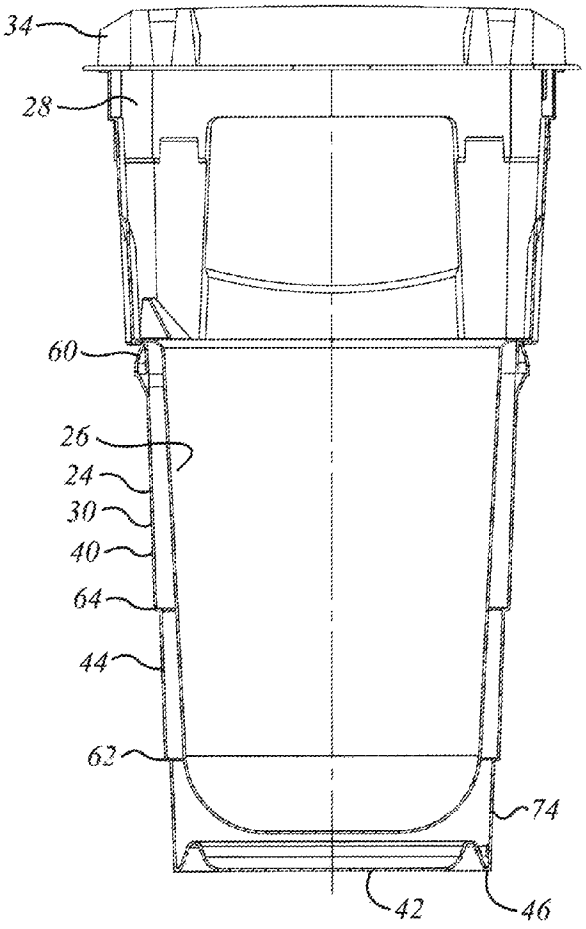
FIG. 1*c* shows the apparatus of FIG. 1*a* in cross-section.

The description that follows, and the embodiments described therein, are provided by way of illustration of an example, or examples, of particular embodiments incorporating one or more of the principles, aspects and features of the present invention. These examples are provided for the purposes of explanation, and not of limitation, of those principles and of the invention. In the description, like parts are marked throughout the specification and the drawings with the same respective reference numerals. The drawings may be understood to be to scale and in proportion unless otherwise noted. The wording used herein is intended to include both singular and plural where such would be understood, and to include synonyms or analogous terminology to the terminology used, and to include equivalents thereof in English or in any language into which this specification many be translated, without being limited to specific words or phrases.

The scope of the invention herein is defined by the claims. Though the claims are supported by the description, they are not limited to any particular example or embodiment, and any claim may encompass processes or apparatus other than the specific examples described below. Other than as indicated in the claims themselves, the claims are not limited to apparatus or processes having all of the features of any one apparatus or process described below, or to features common to multiple or all of the apparatus described below. It is possible that an apparatus, feature, or process described below is not an embodiment of any claimed invention.

For the purposes of this description, it may be that a cylindrical polar frame of reference may be employed. That is, the description may pertain to bins and bin liners that are formed as bodies of revolution about a central longitudinal axis. In such a frame of reference, the longitudinal axis, being the long axis of the apparatus, may be the vertical or z-axis, and the liner or bin may have a circumferentially extending wall that varies in radius as a function of vertical height. In such a frame of reference, the long, or largest, dimension of an object may be considered to extend in the direction of the z-axis, the base of the article, where substantially planar, may be considered to extend in an r-theta plane, and the height of the article may be measured in the vertical, or z-direction. Unless noted otherwise, the terms "inside" and "outside", "inwardly" and "outwardly", refer to location or orientation relative to the bin or liner walls. In this description, when an item, or structure, or wall, is indicated as being insulated, such term is understood to mean that the wall has a layer of insulation. In this specification, the commonly used engineering terms "proud", "flush" and "shy" may be used to denote items that, respectively, protrude beyond an adjacent element, are level with an adjacent element, or do not extend as far as an adjacent element, the terms corresponding conceptually to the conditions of "greater than", "equal to" and "less than".

The terminology used in this specification is thought to be consistent with the customary and ordinary meanings of those terms as they would be understood by a person of ordinary skill in the art in North America. The Applicants expressly exclude all interpretations that are inconsistent with this specification, and, in particular, expressly exclude any interpretation of the claims or the language used in this specification such as may be made in the USPTO, or in any other Patent Office, other than those interpretations for which express support can be demonstrated in this specification or in objective evidence of record, demonstrating how the terms are used and understood by persons of ordinary skill in the art, or by way of expert evidence of a person or persons of experience in the art.

Referring to the Figures, and by way of a general overview, a collection apparatus is shown in FIG. 1*a* generally as 20, sitting in the ground 10. The ground surface, or grade, is identified as 12. Collection apparatus 20 includes a movable receptacle 22, and a stationary liner apparatus 24. Movable receptacle 22 may typically include a wall structure or shell 30 having a chamber 32 defined therewithin in which to collect material, which may commonly be refuse or recyclable materials. Receptacle 22 may also include a closure, or covering, or top or lid, generally indicated as 34, which itself may have openings or inlets, or flaps or doors by which persons may put refuse into lower portion 26 chamber 32. Receptacle 22 may also have a lifting fitting, or fittings, 36 by which receptacle 22 is lifted and emptied, such as by tipping. Fittings 36 may be lifting interface fittings such as sleeves, or guides, or tubes 38 mounted on opposite sides of receptacle 22 such as may admit the entry of the forks of a lift truck. In the usual manner, the lift truck may raise receptacle 22 into the air, and may tip it backward to dump the contents of receptacle 22 into the back of the lift truck, where, often, there is an hydraulically driven ram that compacts the materials. In this process, the main lid swings open under gravity. The lift truck then reverse the process to put receptacle 22 back down. In putting receptacle 22 back down, the lower portion 26 of receptacle 22 may located inside liner apparatus 24, while upper portion 28 remains above ground and accessible by persons wishing to use receptacle 22. Receptacle 22 and liner 24 may have mutually engaging interface members that mate when receptacle 22 is lowered to sit inside liner 24.

Figures 2A, 2B:
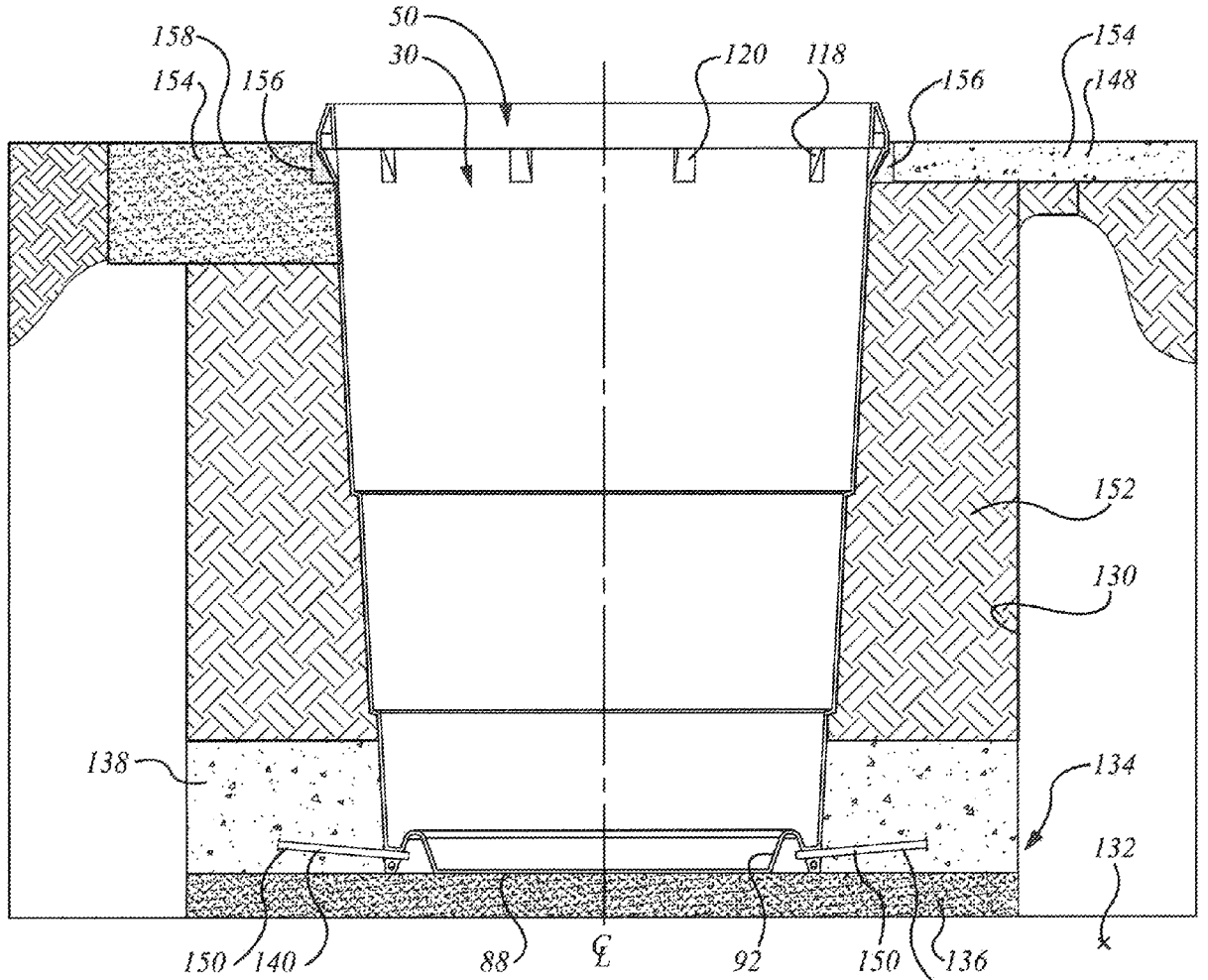
FIG. 2*a* shows a general arrangement, in cross-section, of a liner installation for the apparatus of FIG. 1*a* with a soil or compacted gravel cover.
FIG. 2*b* shows a general arrangement similar to that of FIG. 2*a*, but with a concrete installation cover.
Figure 3A:
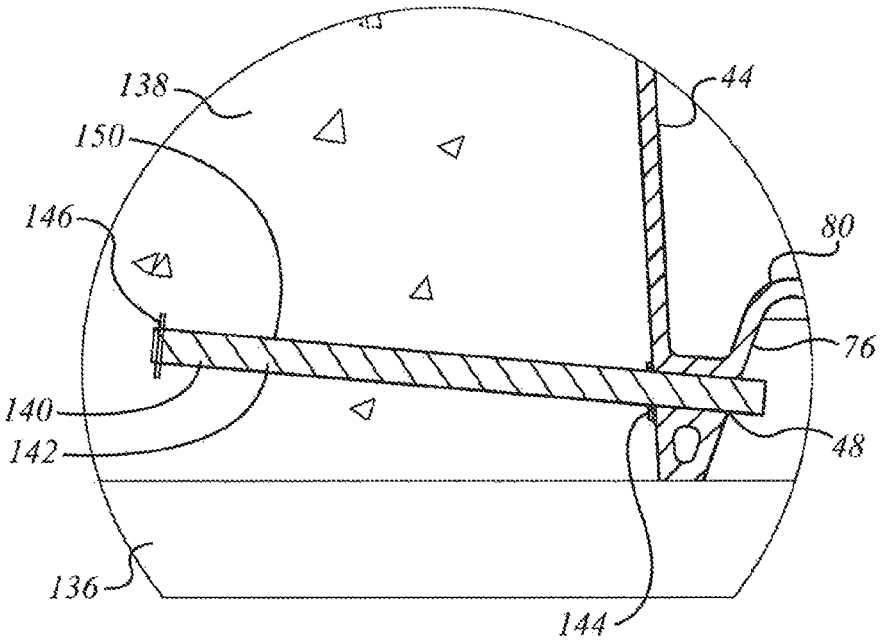
FIG. 3*a* shows an enlarged socket fitting detail of the liner installation of FIG. 2*a;*
Figure 3B:
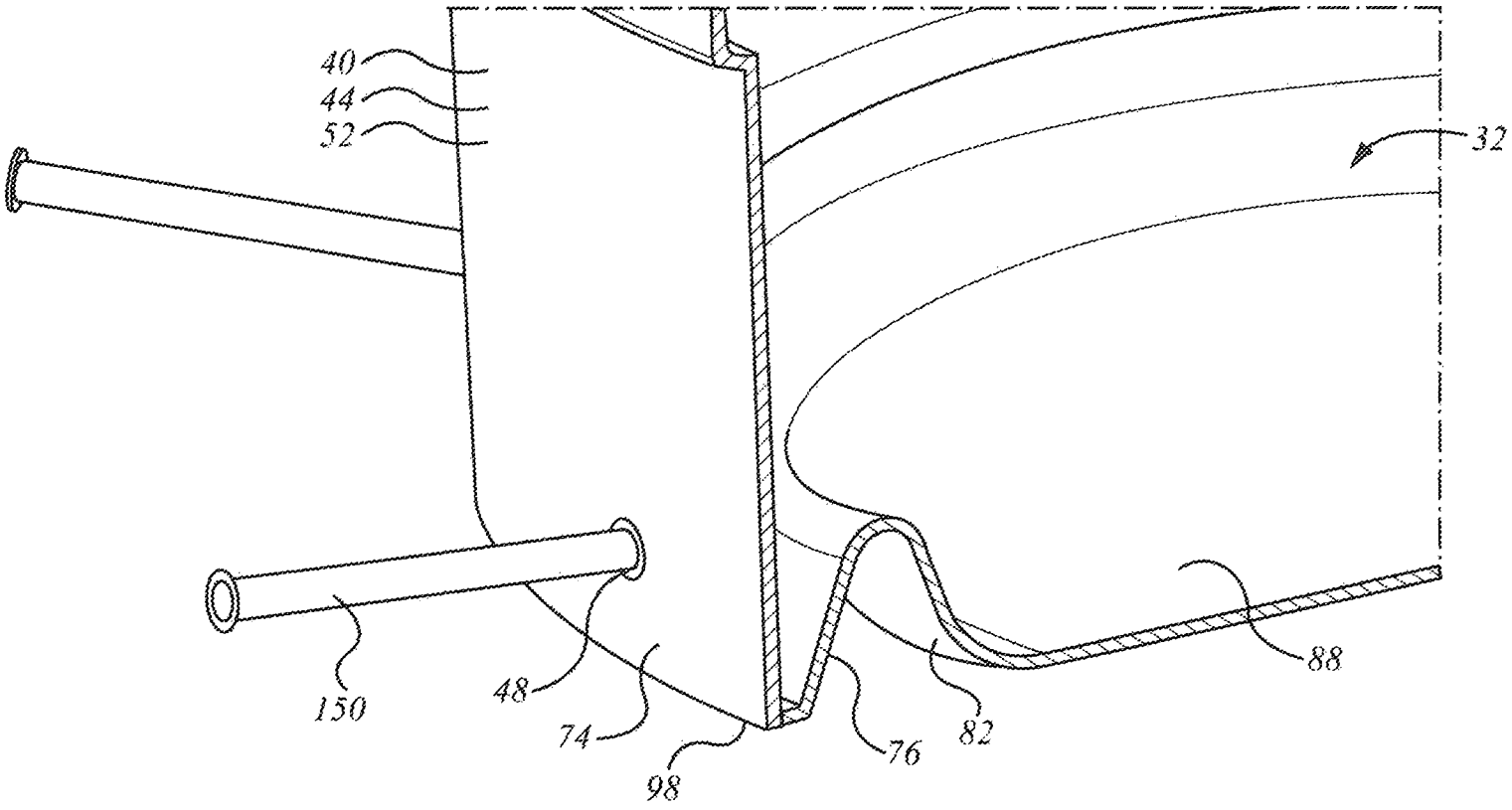
FIG. 3*b* shows a perspective view of the detail of FIG. 3*a;*

Liner apparatus 24 is shown without receptacle 22 in FIGS. 2, 3*a* and 3*b*. Liner apparatus 22 may include a liner 40 having a base portion, or member, or wall panel 42, and a peripheral wall 44 that stands upwardly of base wall panel 42. Peripheral wall 44 and base wall panel 42 co-operate to define a chamber 50 within liner 40 in which to receive the butt end, i.e., the lower portion, of receptacle 22, liner 40 being suitably sized for that purpose. Peripheral wall 44 has a lower region 52, an intermediate region 54, and an upper region 56. At the uppermost end of upper region 56 there is a ring, or lip, or rim, or seat, indicated generally as 60. In one embodiment the depth to the underside of rim 60 may be of the order of 5 ft-7 ft, although it could be larger or smaller. In one embodiment it may be about 6-½ ft. The lower, intermediate, and upper regions need not be of equal vertical depth, although they could be. In one embodiment the upper region 56 is about twice as deep as each of the intermediate and lower regions 54 and 52. In one embodiment upper region 56 is 39 inches deep; intermediate region 54 is 22 inches deep, and bottom region 52 is 18 inches deep. Each of the wall portions or wall regions may have a draft angle. Although the draft angles need not be the same it is convenient that they be the same. In one embodiment the draft angle is about 2 degrees from vertical. The draft angle permits the bodies of successive liners 40 to be nested, or stacked, one inside the other as for shipping.

Lower region 52 of peripheral wall 44 also has a lowermost end or edge or margin, indicated generally as 46, and an array of seats or receptacles, or sockets, or mounting fittings, indicated as 48, such as described in greater detail below.

Well liners have been made of such materials as poured concrete or cast iron. Peripheral wall 44, and all of liner 24, may be produced as a molded product. In particular liner 24 may be a rotationally molded product. The liner may be quite deep. The outside bottom diameter of the liner may be of the order of somewhat less than 4 ft. (e.g., approx. 42-44 inches); and the outside top diameter inside the rim (i.e., the sidewall diameter, not the overall diameter over the rim) may be somewhat less than 5 ft. (e.g., approx. 54-57 inches). The material of the molded product may be a plastic, or polymer, such as PVC or ABS or a polyolefin.

Figure 6:
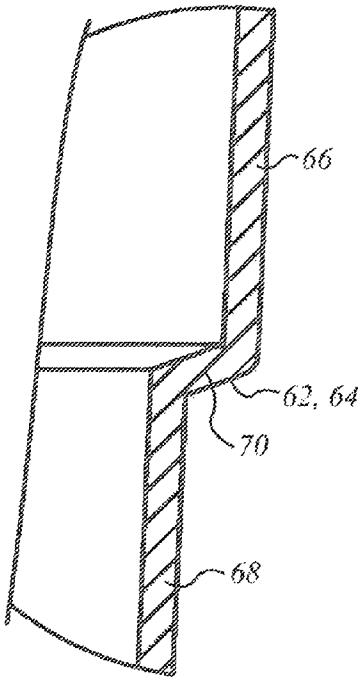
FIG. 6 shows another enlarged detail of the liner of FIG. 1*c;*

The material of the molded product may have a thickness, which may be ¼" to ⅜" or ½" (6 mm-10 mm-12 mm), for example, that is small, or very small, relative to the diameter (and therefore to the circumference) of the peripheral wall at any given height, and that may likewise be small relative to the lineal height along the slope of the wall from bottom to top. As such, it may be considered to be a web with relatively low resistance to buckling. Peripheral wall may have sectional reinforcement, or sectional stiffening at one or more locations spaced between bottom wall or member 42 and rim 60. That stiffening may have the form of a wall step, or jog, as at 62, 64, which may be circumferentially extending out-of-plane discontinuities, or ridges, or folds, or ribs. As shown in the detail of FIG. 6, each rib has an upper web portion 66, a low web portion 68, and a shoulder or rib or step 70. The discontinuity in the section defined by rib 70 may tend to affect the bending stiffness of the adjacent structure for a distance of 20-40 wall thicknesses away from the rib. That is, rib 70 may tend to act as a shear web extending between upper web portion 66 and lower web portion 68, such that a Z-section is formed, with portions 66 and 68 acting as opposed flanges. The radial extent of rib 70 (or, equivalently, the radial offset of web portion 66 from web portion 68 immediately above and below the discontinuity) may be about ¾"-1", where the wall thickness of the web is about 0.25-0.3", such that the local second moment of area for resistance in out-of-plane bending in the r-direction is perhaps as much as 30-50 times the stiffness of the adjacent web. This may tend to make the steps 62, 64 function as local buckling resistant nodes. Although only two such stiffeners or ribs are shown, there could be more than two. The spacing of any such stiffeners may be closer together with increasing depth.

Figure 5A:
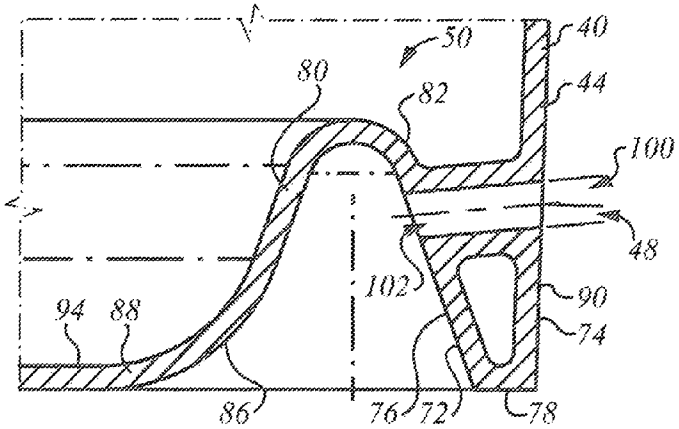
FIG. 5*a* shows an enlarged detail of the liner of FIG. 1*c;* at the location of an anchor fitting.
Figure 5B:
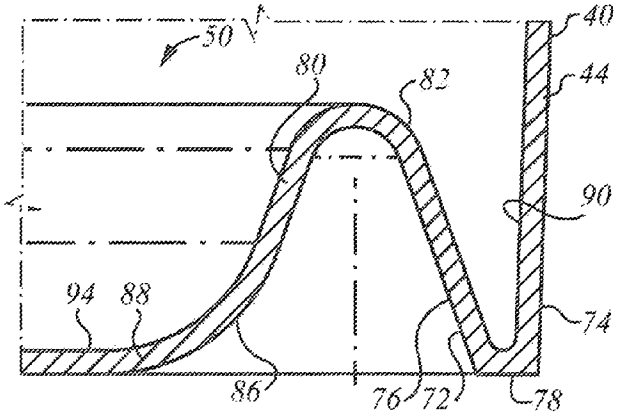
FIG. 5*b* shows an enlarged detail of the liner of FIG. 1*c* at a location circumferentially between anchor fittings.

As seen in larger detail in FIGS 5*a* and 5*b*, at the bottom of liner 40, the lowermost edge may also have, or be formed to have, a stiffener feature, as indicated as stiffener 72. Stiffener 72 may define a beam, or beam section, such as may resist deflection in the vertical direction and in the radial direction. That is, the bottom margin or skirt 74 may define one element of a beam. Radially inwardly of skirt 74 may be a circumferentially extending leg 76. In one embodiment, leg 76 may be formed as a truncated conical ring. The lower end of the ring is joined to the bottom edge or bottom extremity of skirt 74 as at a web, or junction, or shear flow connection 78. The beam structure or section may also include a third portion or leg 80, which may also be a truncated conical ring, and which may be joined to leg 76 by a first radiused portion 82 which may define a shear flow connection between leg 76 and leg 80. Leg 80 is itself connected by a second radiused potion 86 to a main, central, spanning panel or web 88 that closes the end of bottom panel or base wall member 42.

As seen more clearly in FIG. 5*b*, the combination of leg 76, skirt 74 and shear flow connection 78 may tend to form a channel section. The embodiment illustrated shows an upwardly-opening V-shaped channel 90. This channel defines a beam that has greater stiffness in resistance to radial bending than skirt 74 alone, and the also has enhanced resistance to deflection in the axial or z-direction. This structure formed at the region of the outer peripheral lower margin of liner 40 can be thought of as a doubled, or doubled-over, or folded-over, lower skirt, or edge, or form, in which there is an outer leg, and inner leg, and a member joining the inner and outer legs, that structure providing enhanced stiffness.

Similarly, the combination of skirt 74, shear flow connection 78, leg 76, shear flow connection 82 and leg 80 may tend to form a Z-shaped section 92 that is, again, resistant to bending in the radial direction, and also resistant to bending in the axial direction. The radially outward margin 94 of spanning panel or web 88 that is influenced by leg 80 may also function as a flange attached to leg 80.

The overall diameter of the bottom end of liner 40 can be taken as the outside diameter at the corner formed between skirt 74 and shear flow connection 78. The radial extent of the Z-section may be taken as the difference in radius between that outer corner and the intersection of the tangent of leg 80 and the plane of web 88. The unsupported diametral span of web 80 is then the overall diameter less twice the radial extent of the circumferential stiffening. The circumferential edge beam has two effects on bottom panel stiffness. First, it effectively reduces the unsupported span, which has a strong effect on displacement under load. In one embodiment, the outside diameter is 46 inches, and the effective stiffener radial extent is about 5 inches, leaving an unsupported span of about 36 inches, rather than 46 inches. Second, the effect of the stiffener is such as to change the boundary condition of the membrane from a condition that may approximate a simple support to a condition more like a fixed support. Even partial stiffening of the boundary condition may tend to reduce deflection in web 88. This may reduce the tendency of web 88 to deflect upward under the force of buoyance, with a similar decrease in the tendency to impair the ability of the receptacle to seat fully downwardly within liner 40. It may also tend to transfer the vertical load into sidewall 44, and thence into anchors 140.

An array of mounting fittings, or anchor mounts, or sockets, or hard points, or seats, 48, however termed, is, or are, formed about the periphery of the lower margin of lower region 52. In one embodiment there may be 8 such fittings arrayed on 45 deg. centers. There may be more or fewer such fittings as may be appropriate.

Each such fitting may include an aperture or accommodation, or penetration, or hole 100 formed through skirt 76 at a level higher than the bottom edge 98 of skirt 76. In the embodiment shown, that distance may be approximately 3 inches. Other suitable distances may be used. A further penetration or accommodation, or hole, 102 may be made in leg 76. The respective penetrations may be radially aligned, such as to admit a common shaft or rod. The size of the holes may be suitable for accepting a standard diameter of reinforcing bar, such as ¾" re-bar. It may also be that an enclosing wall, such as a cylindrical pipe nipple or stub 104, is formed in liner 40 to extend between holes 100 and 102, forming a sealed passage such that the inside of the tub is segregated from the inside chamber. That is, in the embodiment shown, liquid can neither enter chamber 50 from outside, nor can liquid from chamber 50 leak out through fittings 48. The alignment of holes 100 and 102, and of cylindrical pipe stub 104 may be radially outwardly and upwardly, such that the centerline of the seat is angled upwardly at an angle alpha. Alpha may be of the order of 0-10 degrees, measured from horizontal, and in one embodiment is 5 degrees. It may be a relatively small angle. Since holes 100 and 102 are spaced by a radial distance, and stub 104 has a non-trivial radial extent, the socket defines a moment arm for resisting rotation. That is, it defines a moment connection, or a built-in connection as opposed to a pin-jointed connection. The mounting is set in the circumferentially extending beam, and so has the torsional resistance of that section. Spanning panel member 88 of web 42 may be flush with, i.e., co-planar with, the lowermost edge 98 of skirt 76. Alternatively, panel member 88 may be located higher than edge 98.

At the upper end of liner 40, peripheral wall 44 carries through all the way to the uppermost edge 108 of rim 60. This edge is than carried outwardly and downwardly in a peripherally extending skirt 110 that has an external conical surface defining a land or seat for engagement with or by the mating elements of receptacle 22. The lower margin of skirt 110 gives onto a circumferentially extending cylindrical band 112. There is a cavity or space 114 that is located between peripheral wall 44 and skirt 110, and between peripheral wall 44 and band 112. Liner 40 may be made by rotational molding. An array of skirt reinforcement blisters, or pockets 120 are spaced circumferentially about the upper region of wall 44. Pockets 120 may include wedge-shaped side-wall members 118 that serve to reinforce skirt 110 and also to provide a lead-in, or chamfer, or self-centering set of cams to locate liner 40 within its installation seat. Pockets 120 provide the access path by which the molding material enters the space between the inner and outer tool portions that make item 110 and the uppermost cuff of item 44. Pockets 120 may include a series of radial webs 116 such as may, in addition, serve to discourage radially inward deflection of skirt 110. An array of circumferentially spaced skirt reinforcement blisters 120 includes wedge-shaped members 118 that serve to reinforce skirt 110 and also to provide a lead-in, or chamfer, or self-centering set of cams to locate liner 40 within its installation seat.

The installation configuration is shown in FIGS. 2*a* and 2 *b*. A well 130 is excavated in the geological formation in which liner 40 is to be mounted. The undisturbed stratum of soil is indicated as 132. The bottom of the excavated well is shown as 134. It is either levelled, or covered with a layer of fill that is then itself levelled and compacted to form a packed base material 136.

Liner 40 has a series of anchors 140 mounted in seats 48. Anchors 140 may have the form of straight rods 142, such as the ubiquitously available ¾" rebar, cut to length. When the re-bar sits in the seats, the extending lengths of re-bar define prongs 150. The prongs are angled upwardly. Washers 144 may be mounted on the rods, e.g., by welding, to sit tightly against the outside face of liner 40. This may tend to prevent the inside tip of the re-bar from abutting leg 80. The rods may also have a large washer or washers welded to their ends as at 146.

Figure 4:
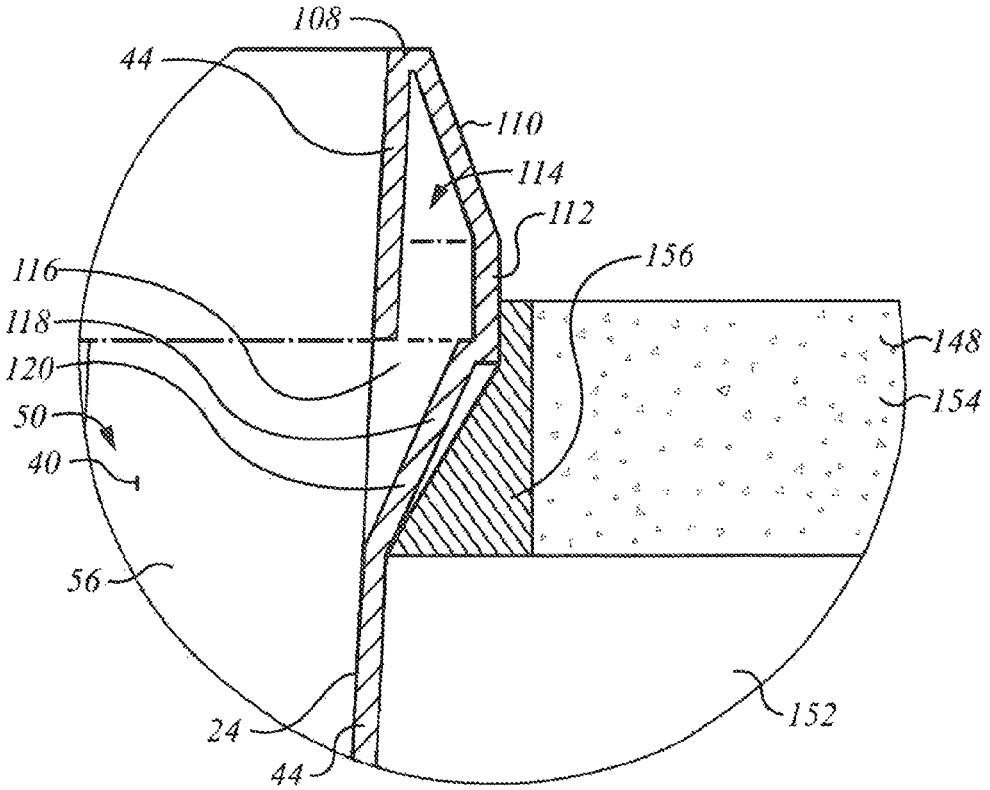
FIG. 4 shows an enlarged detail of a rim of the liner installation of FIG. 2*a;*

Liner 40, with prongs 150 installed, is lowered into the cavity, i.e., well 130. Once in position with lowermost edge 98 tight against the packed base material 136. As so positioned, a layer of concrete 138 is poured into the bottom of well 130 about the lower portion or region 52 of liner 40. Since prongs 150 are spaced upwardly from bottom edge 98, the concrete will flow beneath them, but not below edge 98, and, as the concrete is poured it embeds the prongs. When the pouring is finished, the concrete sets to form an annular footing, and anchor. Fill 152 is then placed on top of the concrete, and compacted. A surface layer 154 is added. The surface layer can be compacted gravel, as in FIG. 2*a*: or it can be a layer of concrete 148, as in FIG. 2*b*. A break, such as a sidewalk concrete expansion joint or frost break or bond break, 156 is mounted about belt or band 112. As seen in the larger detail of FIG. 4, frost break 156 may be made by a lay-up of sections of break material between adjacent blisters 116 and circumferentially around liner 40, with the outside edge or face being generally cylindrical, such that settling or heaving of the top layer, be it fill 158 or concrete 148, may tend to be less prone to "pry" on rim 60. The frost break material provides a radially inner wall of the form when concrete 148 is poured.

In the alternate embodiment of FIGS. 7*a* -7*c*, a liner 160, which may be taken as being the same as liner 40 except as indicated, has a lowermost skirt or margin, indicated generally as 162 that is doubled, i.e., is of doubled thickness as compared to sidewall 164 more generally, and that has an over-folded curved base periphery, or radiused rim, 166 that connects skirt 162 to an inner leg 168. In this instance, the doubled lower margin is a double-thickness wall, rather than the V-shaped channel legs described above. Leg 168 and bottom web central portion 170 meet at another radiused edge or corner, or transition, 176. A fitting bore, or seat 172, penetrates the double thickness. An anchor 140 locates in seat 172 as indicated in FIG. 7*c*. In this embodiment, radially inward motion of anchor 140 is inhibited by leg 168. While this section may be circumferentially continuous as in liner 40, in the embodiment of FIG. 7*a* the anchor seats are defined in a set of circumferentially spaced impressions or pockets 174 located around the bottom of liner 160.

In the alternate embodiment of FIGS. 7*d* and 7*e*, a liner 180 is similar to liner 160, but rather than having a substantially horizontal seat, or one that is back-stopped by leg 168, liner 180 has an inclined seat 182 that is slanted upwardly and outwardly, such that a somewhat longer anchor 140 locates in a manner that is roughly tangent to the bottom radius of leg 168.

In each of liner 160 and liner 180, the anchor fitting extends through a wall member of increased thickness, i.e., the local thickness, and hence the length of the bore of the anchor seat aperture, is greater than the usual through thickness of the wall web of liner 44 generally, and may therefore be less prone to tearing. Further, the use of at least two spaced apart or divergent legs, namely as at 162 and 168, connected by a web in the form of the curved radius portion 178.

The general structure of the apparatus is that of a receptacle that has an upper portion and a lower portion. The upper portion generally includes an external access by which to introduce objects into the bin, and a closure member that opens to permit the bin to be emptied. The upper portion also may have lifting apparatus, whether in the form of a lifting eye, or in the form of sleeve in which to receive the forks of a lift truck.

The lower portion generally sits buried in the ground. To that end, a well may have been prepared in the ground, of a suitable size and shape for receiving the lower portion of the bin. It may be helpful to provide a liner for the well. The liner may have several properties. First, the liner may provide a barrier to the flow of liquids. That is, it may provide a barrier to prevent ground-water from filling the sump by weeping into the well from the subterranean earthen walls of the well. It may also provide a barrier to prevent liquids from the bin from migrating into the surrounding geological stratum, be it earth or rock. That is, some liquids in the refuse may tend to be contaminants. It may be desirable to keep those contaminants out of the water table. Accordingly, it may be desirable (and, indeed, may be mandated by law and regulations) that the liner define a barrier to the passage of liquids either to or from the surrounding soil.

The liner may also define a socket that mates with the bin apparatus. For example, the top or upper region of the well liner may define a seat, i.e., a female seat or female engagement interface, in which to accommodate the bin structure. It may be that either the top portion, or the bottom portion, or the transition between the top and bottom portions may define a mating male seat. The mating engagement of the two interface may tend not to be air-tight, but may tend to exclude water, such as rainwater. That is, it is not generally desirable for the well to be prone to fill with water. When water or other liquid collects in the well, it must then be pumped out. This tends to be inconvenient. The mating may also tend to be tight enough to exclude animals.

Part of defining a socket is that the socket must fit the bin apparatus. Clearly, maintaining the socket in a condition of suitable roundness so that it mates with a round belt, or band, or cincture, of the bin, would be desirable. However, the engagement interface need not he circular (or conical), and need not necessarily be continuous. The female fitting defines a land, or an array of lands, onto which a mating interface land, or lands, or arrays of lands is placed. Given that the bin is typically lifted by the forks of a truck, the fit may tend to be either self-centering or have a sufficiently large tolerance to accommodate relatively loose mis-match of fit. In addition to horizontal planar circumferential fit (in polar-co-ordinates) or horizontal planar rectangular fit (in Cartesian co-ordinates), the well must also have a correct vertical fit.

Difficulties with both circumferential and vertical fit may arise from the combination of geological factors, water table factors, freezing and thawing, precipitation, and drainage. The well liner can he thought of as the hull of a vessel floating in water. At any time that there is significant moisture in the geological structure, the liner, as a hollow structure, may tend to be buoyant relative to the surrounding stratum. Even small and slow migration of water, over a long time any many cycles of soaking and drying, or heating and cooling, may tend to push on the liner. In particular, the bottom face of the well liner may be idealised conceptually as facing the equivalent head of pressure of water equal to the depth of the bottom face below the surface multiplied by gravity. That depth may be up to 6 ft, and the diameter of the base wall may be of the order of 4 ft. The pressure on the bottom face of the unit may then approximate a distributed load. The total force of buoyancy on the bottom face of the unit may be substantial.

This force, applied over a long enough time may cause the bottom face to bow upward, and may tend to cause the unit to try to rip upward out of its mounting. The top rim may heave upwardly, thereby causing stress in the area of the anchor pins. At least one known unit has employed concrete reinforcement bars embedded in concrete poured in the well. Unless the re-bar is well set within the concrete, it may tend to tear out.

In the embodiment shown and described in FIGS. 1*a*-2*b*, the radially extending array of prongs may tend to be difficult to tip out of the concrete annulus. First, unlike straight bars mounted in the bottom face of a bin, there is no length of exposed bar such as might be long enough to bend. When the concrete cures, the inside face of the concrete has the same size and shape as the liner, so the re-bar prongs have no space to form a bending arm. The liner cannot move away from the concrete radially, because the opposite sides of liner 40 cannot move into the concrete on the opposite face. The radial geometry means the liner has nowhere to go to slide off the prongs; and it means there is no moment arm to permit the prongs to be bent or twisted. They are constrained to deflection in shear. While bottom panel or member 42 may tend to wish to push liner 40 upward, the hard it pushes, the more forcefully the seats are urged against the concrete, by virtue of the incline of angle alpha.

The sidewall web of liner 40 is relatively thin, as noted above. If the prongs merely passed through a single layer of ¼"-⅜" plastic, the forces working against the liner might tend, over time, to rip an axially extending hole in the web, forcing it to tear on the prong, as if the prong were a dull knife cutting through the plastic. However, the spacing of apertures 100 and 102, the use of an enclosing plastic cylinder 104, and the siting of the cylinder in the webs of a V-shaped beam may tend to spread the reaction of the prong along the circumference of the web, meaning that a greater area of material works to resist the force of buoyancy working against bottom panel or member 42. This arrangement may facilitate manufacturing, e.g., as by rotational molding, and may yield an approximately uniform wall thickness.

On installation, unlike some other kinds of containers, an in-ground apparatus may sometimes be placed or installed behind a curb to save or retain parking lot space, given that the forks of a lift truck may extend well forward of the truck itself. In the cylindrical or truncated conical form embodiments landscaped areas and may be rotated for easier truck access. Before excavating the well, the installer may wish to consider the driving habits of persons in the area; whether room is needed for large vehicles such as trucks or buses to turn, or to reverse; where emergency vehicles are likely to require access in case of fire; where snow plowing is likely to occur or where snow is likely to be piled; and whether the area is one of high pedestrian traffic; and any other site-specific activities that may interfere with the installation, loading and emptying. The site must have room for the lift-truck, and any maneuvering required by the lift-truck, and must be clear of overhead obstructions, such as electrical wires, awnings, signs and so forth. It may be desirable to install the liner away from parking areas, or, if located in a parking area, to install bollards to prevent damage to the installation.

It may be desirable to avoid installation in wet clay soils or in habitually high water-table locations, or locations of high surface water retention. It may also be desirable to avoid installing ground sleeves close to large rocks and roots. The site may have a 1 m (40 inch) clearance, or more, from the ground sleeve location to any utilities; including storm sewer drain pipes. It may have a 3 m (10 ft), or more, clearance to a transformer, and the locally required set-back back from fire hydrants. The liner should not, of course, be located directly above underground structures or utilities; including sewer drainpipes.

A site may be chosen that is substantially level from side-to-side when facing the installation from the front, although it may have a grade (e.g., a slight up-grade) in the direction of approach of the lift-truck. Unless blasting is expected, it is helpful to make sure that the depth to bedrock exceeds the depth of the liner. Assuming that a suitable site has been selected, such as may have good sub-soil drainage, and appropriate clearances from adjacent structures and uses, the well is excavated to depth and back-filled with a minimum of a 10 cm (4 inch) layer of compacted sand or granular 'A' gravel.

Where there is more than one assembly to be installed, it is important to make sure that the spacing between the sleeves is carefully measured to assure minimum clearance. The clearance is greater where lift-truck access is oblique rather than perpendicular to the line of centers of adjacent units.

The installer seats the supplied anchor pins, of which there may be 8 in a set. Alternatively, the installer may use readily and locally available re-bar, cut to length. The anchor pins may be standard 20 M (approx. ¾") rebar pins. They seat in the 8 holes or sockets, or seats near the bottom of the liner. The ground sleeve is hoisted into the pit using lifting equipment of adequate capacity, such as a back-hoe or crane. When cited, the liner is positioned level side-to-side and fore-and-aft. Care is taken to make sure that the pins are clear of any rocks, or stones, or debris that might obstruct the flow of concrete or the secure embedment of the pins in the concrete.

When straight and level, concrete is poured into the well about the bottom of the liner, to a depth of 8-12 inches, or slightly more, typically about 1 cu. yd. or 1 cu. metre of concrete, poured in an annulus about the bottom of the liner. The concrete is allowed to cure. Once it has cured, backfill is added. The backfill may be granular 'A' gravel (¾ minus). It is compacted evenly in 200-300 mm (8-12inch) lifts with a greater than 95% compaction. Alternatively, non-shrink clear stone such as ¾" clear, may be used provided that landscape fabric is draped down all sides of the pit prior to back-filling. The landscape fabric prevents the adjacent soil fines from migrating into the aggregate over time. Alternatively, previously excavated soil may be used if it is not material that may freeze, such as clay or silt. It is compacted evenly in 200-300 mm (8-12 inch) lifts with a greater than 95% compaction. At each step, the installer may wish to verify that the liner is within 1" (preferably ¼") of roundness by measuring in directions 90 degrees apart (preferably four directions, 45 degrees apart). It is desirable not to drive equipment onto backfilled material, as it may tend to distort the ground sleeve.

Although the various embodiments have been illustrated and described herein, the principles of the present invention are not limited to these specific examples which are given by way of illustration, but only by a purposive reading of the claims.

I claim:

1. A ground well liner, comprising a bottom member and a peripheral wall extending thereabout and standing upwardly therefrom, said bottom member and said peripheral wall defining a chamber therewithin;

said peripheral wall having an upper region and a lower region;

said lower region having a lowermost margin defining a beam, said beam including at least a first web extending at least partially in the vertical direction and a second web extending at least partially in the vertical direction, there being a shear flow connection between said first and second webs, said first web being peripherally outwardly of said second web;

said lower region of said peripheral wall having an array of anchor seats defined in said beam; and any seat of said array of seats connects with both said first web of said beam and said second web of said beam.

2. The ground well liner of claim 1 wherein said anchor seats define moment connections.

3. The ground well liner of claim 1 wherein said first web has a bottom edge, and said shear flow connection, is located upwardly of said bottom edge.

4. A ground well liner as claimed in claim 1 wherein said liner is nestingly stackable with other liners of the same type.

5. The ground well liner of claim 1 wherein said liner is made of a polymeric material.

6. The ground well liner of claim 1 wherein said liner includes at least one conically tapered wall section.

7. The ground well liner of claim 1 wherein: said peripheral wall of said liner has at least one intermediate region spaced upwardly from said bottom member, said intermediate region having circumferentially extending stiffening that is spaced upwardly of said bottom member; and said circumferentially extending stiffening includes an anti-buckling local increase in second moment of area in the circumferential direction.

8. The ground well liner of claim 1 wherein said seats of said array of seats are spaced upwardly of said lowermost margin.

9. The ground well liner of claim 1 wherein said beam has a channel cross-section.

10. The ground well liner of claim 1 wherein said beam has a third web extending at least partially in the vertical direction, said third web being in shear flow connection with at least one of said first web and said second web.

11. The ground well liner of claim 10 wherein said beam has a Z-section.

12. The ground well liner of claim 1 wherein any seat of said array of seats is inclined upwardly and outwardly.

13. The ground well liner of claim 1 wherein any seat of said array of seats includes a cylindrical socket that is open to the outside.

14. The ground well liner of claim 1 wherein said socket is sized to receive a length of re-bar.

15. The ground well liner of claim 1 wherein said seats are excluded from communication with said chamber.

16. The ground well liner of claim 1 wherein said peripheral wall has a lowermost edge, and said seats are located upwardly of said lowermost edge.

17. The ground well liner of claim 1 wherein said upper region has an upper rim defining an opening of said ground well liner, and said opening defines a land for mating engagement with a vessel sized to fit in said well.

18. The ground well liner of claim 1 in combination with a set of anchor fittings mounted in said anchor seats.

19. The ground well liner of claim 18 wherein said anchor fittings are spaced circumferentially about said liner, and said anchor fittings protrude radially from said seats.

20. A ground well liner, comprising a bottom member and a peripheral wall extending thereabout and standing upwardly therefrom, said bottom member and said peripheral wall defining a chamber therewithin;

said peripheral wall having an upper region and a lower region;

said lower region of said peripheral wall having an array of anchor seats defined therein;

said lower region of said peripheral wall has a doubled lowermost margin, and said anchor seats are located in said liner at a height that is upwardly of a bottommost extremity of said lowermost margin.

21. The ground well liner of claim 20 wherein outwardly extending prongs are mounted in said seats and extend predominantly radially outwardly from said liner.

22. The ground well liner of claim 20 wherein concrete is poured about said liner and said concrete extends both above and below said seats whereby said prongs are embedded in concrete above and below.

23. A ground well liner, comprising a bottom member and a peripheral wall extending thereabout and standing upwardly therefrom, said bottom member and said peripheral wall defining a chamber therewithin;

said peripheral wall having an upper region and a lower region;

said lower region of said peripheral wall having array of anchor seats defined therein;

said lower region of said peripheral wall has a doubled lowermost margin, and said anchor seats are located in said liner at a height that is upwardly of a bottommost extremity of said lowermost margin;

said doubled lowermost margin of said peripheral wall includes a lowermost outermost outer wall, a radially inwardly and upwardly folded bottom rim, said lowermost outer wall and said upwardly folded bottom rim combining to define said doubled lowermost margin, and said seats extend from said outermost wall to said inwardly and upwardly folded bottom rim.

24. A ground well liner, comprising a bottom member and a peripheral wall extending thereabout and standing upwardly therefrom, said bottom member and said peripheral wall defining a chamber therewithin;

said peripheral wall having an upper region and a lower region;

said lower region of said peripheral wall having an array of anchor seats defined therein;

said lower region of said peripheral wall has a doubled lowermost margin, and said anchor seats are located in said liner at a height that is upwardly of a bottommost extremity of said lowermost margin;

said lowermost margin of said peripheral wall defines at least a portion of a channel having an outer wall and an inner wall spaced therefrom, and said seats span said channel.

* * * * *